US006035557A

United States Patent [19]

Mills

[11] Patent Number: 6,035,557

[45] Date of Patent: Mar. 14, 2000

[54] FOOTWEAR FOR WALKING ON AN INCLINED ROOF

[76] Inventor: James D. Mills, 2602 Oakwood Rd., Porter County, Valparaiso, Ind. 46383

[21] Appl. No.: 09/116,779

[22] Filed: Jul. 16, 1998

Related U.S. Application Data

[60] Provisional application No. 60/052,712, Jul. 16, 1997.

[51] Int. Cl.[7] ..... A43B 3/16; A43B 3/00

[52] U.S. Cl. ..... 36/113; 36/114; 36/116; 36/59 R; 36/7.1 R; 36/7.6

[58] Field of Search ..... 36/113, 114, 116, 36/59 R, 7.1 R, 7.7, 7.5, 7.6, 143, 144, 43, 44

[56] References Cited

U.S. PATENT DOCUMENTS

| | | | |
|---|---|---|---|
| 380,395 | 4/1888 | Kramer . | |
| 974,941 | 11/1910 | Wilkerson . | |
| 987,054 | 3/1911 | Eves . | |
| 1,059,565 | 4/1913 | Robinson . | |
| 1,070,951 | 8/1913 | Elliott . | |
| 1,103,108 | 7/1914 | Van Wie . | |
| 1,107,208 | 8/1914 | Styche . | |
| 1,232,114 | 7/1917 | Sorley . | |
| 2,616,190 | 11/1952 | Darby | 36/144 |
| 3,082,548 | 3/1963 | Hartman | 36/116 |
| 3,726,028 | 4/1973 | Stokes | 36/2.5 D |
| 4,689,898 | 9/1987 | Fahey | 36/43 |
| 5,259,125 | 11/1993 | Gromes | 36/59 C |
| 5,345,701 | 9/1994 | Smith | 36/144 |

FOREIGN PATENT DOCUMENTS

| | | | |
|---|---|---|---|
| 2584277 | 1/1987 | France | 36/113 |
| 2591079 | 6/1987 | France | 36/116 |

*Primary Examiner*—Paul T. Sewell
*Assistant Examiner*—Anthony Stashick
*Attorney, Agent, or Firm*—Gary M. Hartman; Domenica N.S. Hartman

[57] ABSTRACT

Footwear (210) that is readily adjustable to maintain the wearer in an upright, substantially vertical position, enabling the wearer to negotiate a steep roof without slipping or falling. The footwear (210) entails a pair of shoe boards (224) that attach to the wearer's shoes or feet. Each shoe board (224) is supported on a base (212) whose shape provides a large surface area that, when in contact with the roof under the weight of the wearer, securely grips the roof surface, even for roof pitches of 12/12. In addition, the shape of each base (212) is tailored to enable a pair of the footwear (210) to nest together, allowing the wearer to place his or her feet close together when desired. In a preferred embodiment, each base (212) is equipped with concave surface regions (228B, 232B) that receive convex portions (228A, 232A) of its mating shoe board (224) in a manner that provides an uncomplicated method of adjusting the pitch of the footwear (210) and securing the shoe board (224) to the base (212).

15 Claims, 6 Drawing Sheets

FOOTWEAR FOR WALKING ON AN INCLINED ROOF

CROSS REFERENCE TO RELATED APPLICATIONS

This application claims the benfit of U.S. Provisional Application No. 60/052,712, filed Jul. 16, 1997.

BACKGROUND OF THE INVENTION

1. Field of the Invention

The present invention generally relates to construction safety equipment. More particularly, this invention relates to footwear configured to be worn while the wearer is walking on an inclined roof, the footwear serving to greatly enhance the safety of the wearer when traversing a roof having a pitch of up to at least 12/12.

2. Description of the Prior Art

The Occupational Safety & Health Association (OSHA) currently requires the use of fall protection equipment anytime a worker is working six feet or more above ground. This requirement applies to workers in a variety of occupations, including roofers, firefighters, emergency rescue personnel, chimney sweeps and fireplace installers. Various equipment has been proposed for those who work on roofs, and particularly sloped roofs, such as those having a roof pitch of 4/12 or more. A common example of such equipment includes a full body harness worn by the worker and secured to a roof anchor attached to the roof peak. Notably, while the worker is securing the roof anchor to the roof, he or she is in violation of the OSHA rule unless additional safety protection equipment is used. Under some circumstances, full compliance with this rule can incur more time than the actual work performed on the roof. Consequently, there is the likelihood that a worker will not employ any fall protection equipment, and take an unnecessary chance of falling when ascending or descending a roof.

Various footwear has been proposed to permit the wearer to safely negotiate a sloped roof. Examples include U.S. Pat. Nos. 380,395 to Kramer, 974,941 to Wilkerson, 987,054 to Eves, 1,070,951 to Elliott, 1,103,108 to Van Wie, 1,107,208 to Styche, 1,232,114 to Sorley, 3,726,028 to Stokes and 5,259,125 to Gromes. Kramer, Styche and Stokes each teach footwear having an adjustable foot support that allows the wearer's foot to be positioned substantially parallel to the ground. Kramer's device includes a foot platform that is pivotally attached to the forward ends of a pair of frames, and adjustably attached to the rearward ends of the frames. Friction points at the rearward (downroof) ends of the frames provide the required traction when walking on a roof. A plate mounted to the platform is adapted to receive the wearer's shoe, and can be adjusted to face forward, sideways or rearward relative to the frames. In order to face or walk in a different direction on the roof, the wearer must adjust the plate to face in the desired direction.

A shoe taught by Styche is similar to that of Kramer, but includes a pair of base plates whose rearward (downroof) ends diverge from each other. As with Kramer, Styche's shoe relies on spikes to grip a roof surface. In contrast to Kramer, the wearer cannot alter the direction in which the wearer faces relative to Styche's shoe. Consequently, the wearer must face the peak of the roof at all times while wearing the shoes. Stokes discloses a roof shoe having a rigid base with a foot support platform that can be adjusted to incline as required by the roof to be walked. Contrary to Kramer and Styche, Stokes does not rely on spikes to grip a roof, but instead employs foamed plastic or rubber material that covers the entire lower surface of the base. As with the shoes of Styche, one wearing Stokes's roof shoe cannot alter the direction in which he or she faces relative to the shoe, necessitating that the wearer face the peak of the roof at all times.

While footwear of the type taught by the prior art enables the wearer to ascend a roof to secure a roof anchor for a body harness, each has shortcomings including a compromise between the roof pitch that can be climbed and the size of the footwear smaller shoes allow the wearer to place his or her feet closer together but reduce the roof contact surface necessary for traction with the roof surface. Each also relies on a relatively complicated structure to permit adjustment of the shoe pitch. Accordingly, further improvements in roof climbing footwear would be desirable, and particularly footwear having a relatively uncomplicated construction that allows the wearer to safely work in an upright position on very steep roofs, e.g., pitches of 12/12 and greater.

SUMMARY OF THE INVENTION

In accordance with this invention, footwear is provided that enables the wearer to negotiate a steep roof without slipping or falling. The footwear does not employ spikes that can damage a roof and wear with repeated use, and is readily adjustable to maintain the wearer in an upright, substantially vertical position. The footwear is preferably worn so that the wearer stands sideways on the roof, i.e., with one leg downroof from the other, which is a more natural and stable position for the wearer.

The footwear of this invention entails a pair of platforms that can be secured to the intended wearer's feet or shoes. Each platform is supported by a base whose shape provides a large surface area that, when in contact with the roof under the weight of the wearer, securely grips the roof surface, even for roof pitches of 12/12. In addition, the shape of each base is tailored to distribute the wearer's weight in a manner that promotes the ability of the base to grip the roof and provide stable support for the wearer. According to a preferred aspect of the invention, the shape of each base is also tailored to enable the devices to nest together, allowing the wearer to place his or her feet close together when desired.

With the above configuration, the footwear of this invention is adapted to transmit the wearer's body weight directly downward through the base of each platform to optimize the contact force between the bases and the roof surface. Testing has shown the footwear of this invention to safely support wearers weighing up to at least 220 pounds (about 100 kilograms) on roofs having a pitch of 14/12, even when standing on only one of the platforms. Finally, the ability to nest the footwear together when worn greatly increases the wearer's mobility when traversing the roof and comfort when required to remain stationary for any length of time. Accordingly, the present invention provides significant advantages over prior art footwear and roof safety equipment. The preferred embodiment of this invention further provides an uncomplicated method of adjusting the pitch of the footwear, involving mating convex and concave portions on the platform and base that help to secure the platform to the base as well as determine the relative pitch of the platform to the base.

BRIEF DESCRIPTION OF THE DRAWINGS

The above and other advantageous of this invention will become more apparent from the following description taken in conjunction with the accompanying Figures, in which.

DETAILED DESCRIPTION OF THE INVENTION

Figure 1:
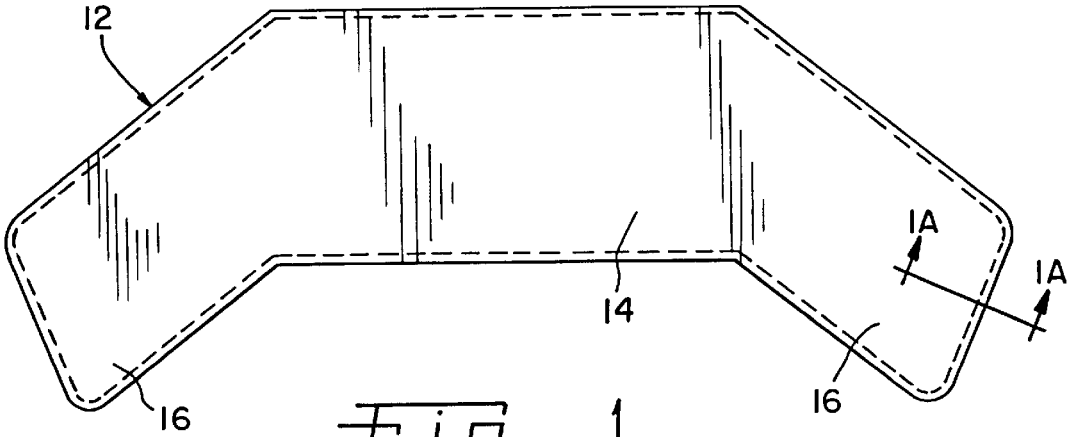
FIG. 1 is a plan view of an upper surface of a base for footwear in accordance with a first embodiment of this invention.
Figure 7:
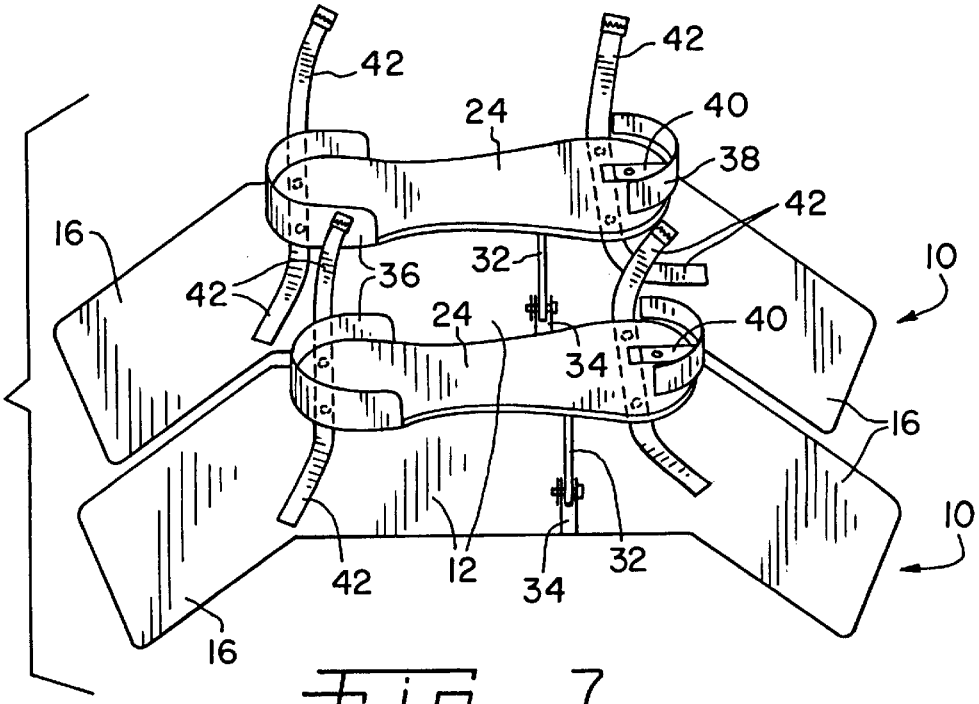
FIG. 7 is a plan view of a pair of footwear in accordance with FIG. 1, the footwear being nested together according to a preferred aspect of this invention.
Figure 9:
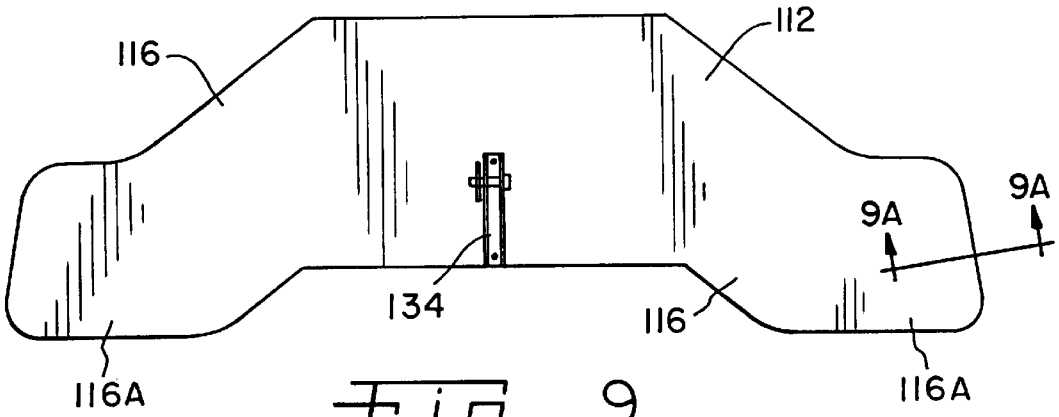
FIG. 9 is a plan view of an upper surface of footwear in accordance with a second embodiment of this invention.
Figure 9A:
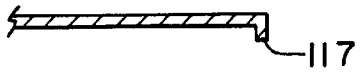
FIG. 9A is a partial cross-section of the footwear of FIG. 9 along line 9A—9A.
Figure 12:
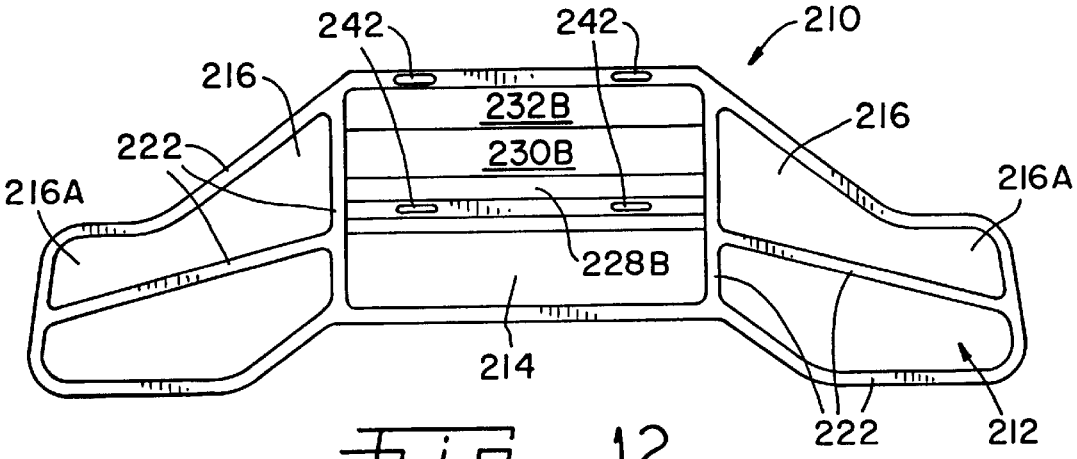
FIG. 12 is a plan view of an upper surface of a base for footwear in accordance with a preferred embodiment of this invention.

The Figures represent roof safety footwear configured in accordance with three embodiments of this invention. Each of the embodiments is characterized by a base having extensions projecting in a direction oblique to the longitudinal and lateral directions of the footwear, creating a swept-wing outline as seen in FIGS. 1, 9 and 12. As shown in FIG. 7, footwear in accordance with this invention has a shape that forms a concave lateral edge and an oppositely-disposed convex lateral edge that enable a pair of the footwear to nest together by placing the footwear side by side such that the convex lateral edge of one of the pair is received in the concave lateral edge of the other footwear.

Figure 1A:
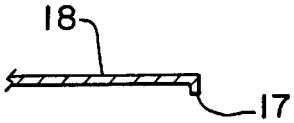
FIG. 1A is a partial cross-section of the footwear of FIG. 1 along line 1A—1A.

FIGS. 1 through 8 illustrate footwear 10 in accordance with a first embodiment of this invention. FIG. 1 is a plan view of a base 12 for the footwear 10, which is shown in its complete form in FIG. 6. As noted above, the base 12 has a swept-wing shape, with a pair of wings 16 extending outwardly from a central portion 14 of the base 12 as shown. In use, the footwear 10 is worn such that the wings 16 are pointed downroof. As shown in FIG. 1A, a raised rim or lip 17 surrounds the lower surface 18 of the base 12, forming a cavity into which a contact pad 20 (FIG. 4) is received. The pad 20 is preferably releasably secured to the lower surface 18 of the base 12, such as with VELCRO strips 22 or another suitable fastening system or device. The pad 20 is preferably formed of a dense foam rubber of a type commercially available.

Figure 2:
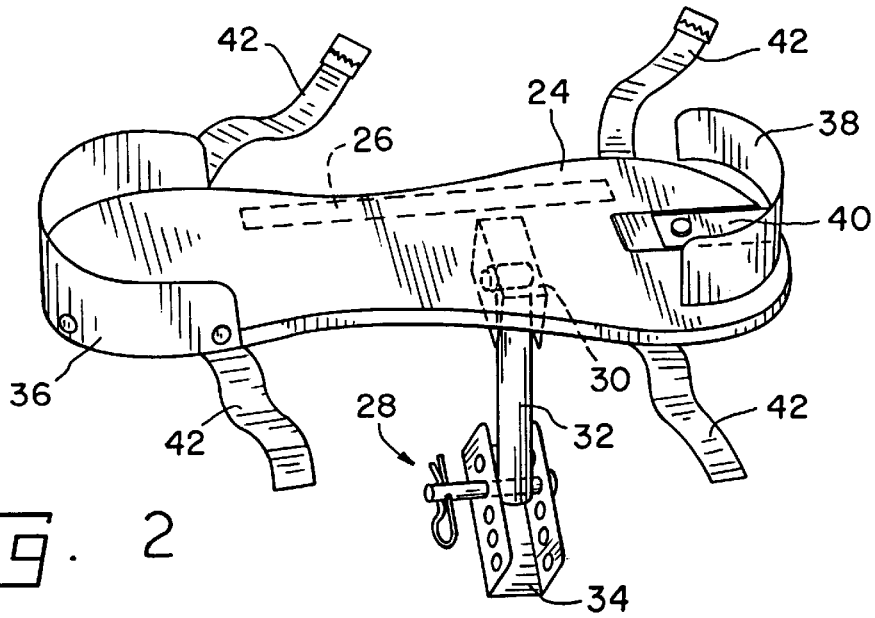
FIG. 2 is a perspective view of a shoe board mounted to the upper surface of the footwear of FIG. 1.
Figure 6:
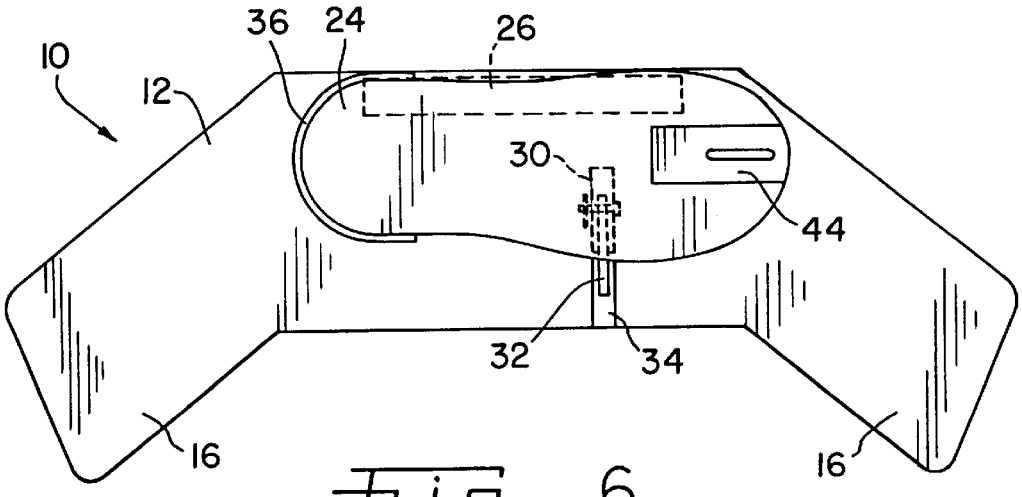
FIG. 6 is a plan view of the upper surface of the footwear of FIG. 1 with the shoe board of FIG. 2.
Figure 6A:
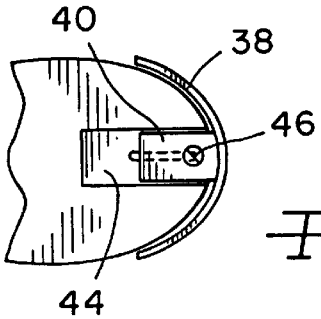
FIG. 6A is a detailed view of a shoe toe retainer for the shoe board of FIG. 6.

The footwear 10 of FIGS. 1 through 8 is formed by strapping ones shoes to a suitable platform, referred to herein as a shoe board 24 shown in FIGS. 2, 6 and 7. The shoe board 24 is pivotally mounted to the base 12 with a suitable hinge-type device or flexible member, such as the hinge 26 shown in FIGS. 2 and 6. The hinge 26 is shown as being located at an uproof edge of the shoe board 24 and base 12, i.e., opposite the direction in which the wings 16 extend. The opposite edge of the shoe board 24 is adjustably mounted to the base 12 with a roof pitch adjuster 28, shown as being formed by a pair of channel brackets 30 and 34 coupled to a rod 32. One bracket 30 is secured to the lower surface of the shoe board 24, the second bracket 34 is secured to the upper surface of the base 12, and the rod 32 is pivotally and adjustably coupled therebetween with a pin a cotter key. A series of holes in the second bracket 34 enable the pitch of the shoe board 24 to be altered relative to the base 12, thereby allowing the shoe board 24 to be maintained roughly horizontal regardless of the pitch of the roof on which the footwear 10 is used. While the rod 32 and brackets 30 and 34 have been found to perform well for the intended purpose of this invention, it is foreseeable that other adjustment mechanisms could be used as the pitch adjuster 28, such as a threaded adjuster or a ratchet-type mechanism.

FIGS. 2, 6, 6A and 7 further show the shoe board 24 as including a heel retainer 36, a toe retainer 38, and straps 42 with which the wearer's shoes are secured to the shoe board 24. In the embodiment of FIGS. 1 through 8, only the toe retainer 38 is adjustable by means of a tab 40 secured with a fastener 46 to a slotted base plate 44 on the shoe board 24. With the adjustable toe retainer 38, the shoe board 24 can be easily adjusted to accommodate shoes of various sizes.

Figure 8:
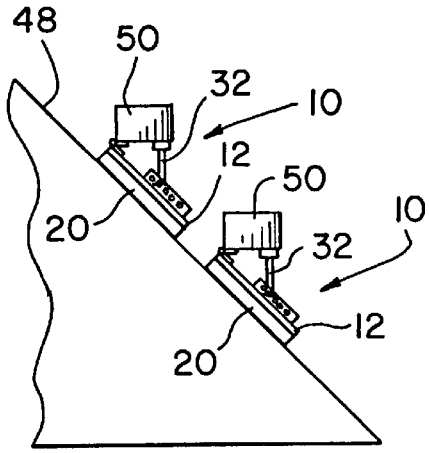
FIG. 8 is a side view of the footwear of FIG. 7 as they appear when used on a roof with a 12/12 pitch.
Figure 4:
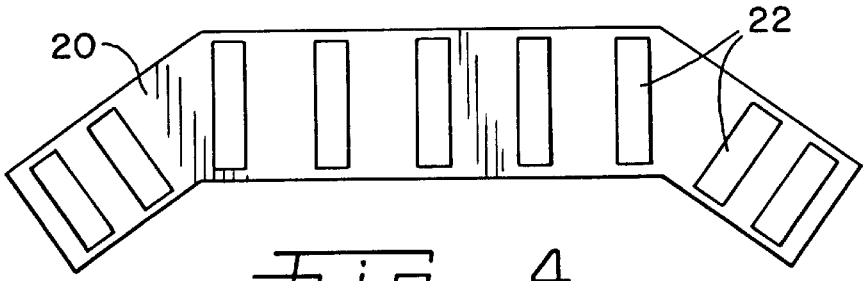
FIG. 4 is a plan view of a contact pad for the device of FIG. 1, showing a surface of the contac pad adapted for securement to a lower surface of the footwear.
Figure 5:
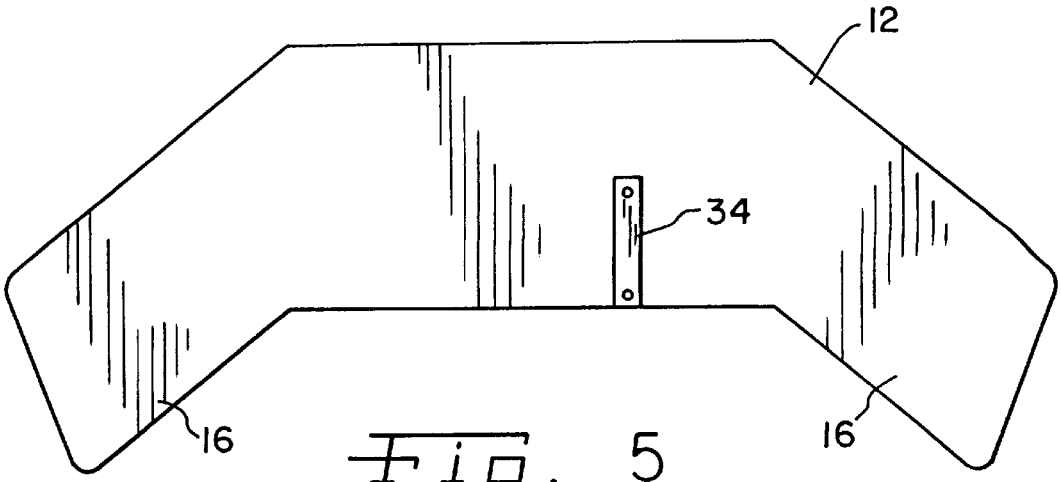
FIG. 5 is a plan view of the upper surface of the footwear of FIG. 1 with a bracket for the adjuster of FIGS. 2 and 3 but without the shoe board for sake of clarity.

FIG. 8 shows a pair of footwear 10 in use on a roof 48 with a 12/12 pitch. As shown, the pitch adjuster 28 has been adjusted to maintain the wearer's shoes 50 roughly horizontal, such that the wearer is able to stand substantially vertical. While shown as being spaced apart along the pitch of the roof 48, the footwear 10 of this invention can be nested as shown in FIG. 7. In so doing, the wearer is able to benefit from the greater stability and traction provided by the wings 16, yet can also bring his or her feet close together for comfort when the wearer must remain stationary for any given length of time.

Figure 10:
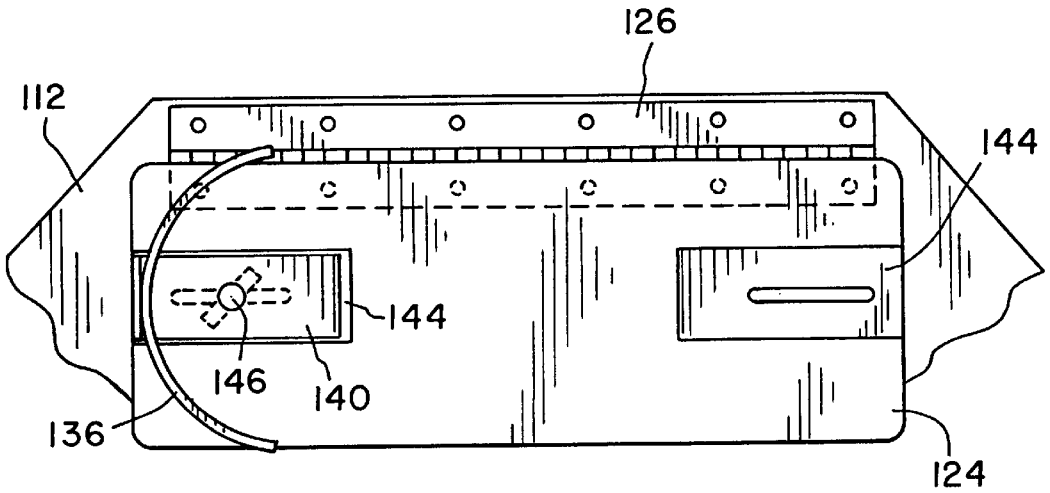
FIG. 10 is a plan view of a shoe board mounted to the upper surface of the footwear of FIG. 9.
Figure 11:
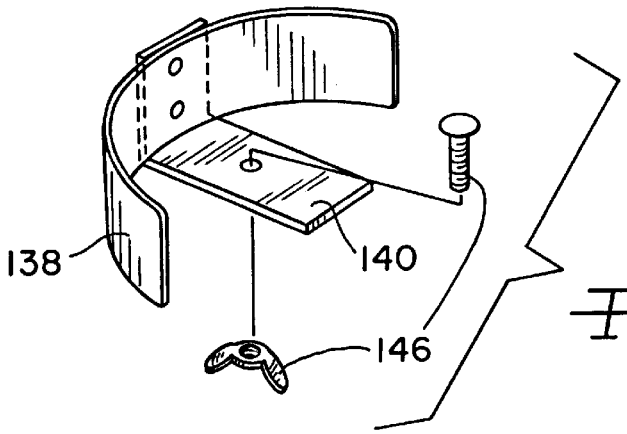
FIG. 11 is a detailed view of a toe and heel retainer for the shoe board of FIG. 10.

FIGS. 9 through 11 show a footwear 110 in accordance with a second embodiment of this invention. The footwear 110 is similar to the footwear 10 of FIGS. 1 through 8, with the exception that the outline of the base 112 of the footwear 110 differs from that of the footwear 10, the contact pad 120 is preferably an open cell #70 foam rubber having a preferred thickness of about 1.25 inches (about thirty millimeters), and the heel retainer 136 is configured to be adjustable in the same manner as the toe retainer 138 with a tab 140 secured by a fastener 146 to a slotted base plate 144. The latter feature enables the footwear 110 to be worn on either of the wearer's feet if the shoe board 124 and heel and toe retainers 136 and 138 are appropriately shaped as shown in FIG. 10. The shape of the base 112 is the more prominent difference from the footwear 10 of FIGS. 1 through 8. As indicated, the wings 116 include longitudinal extensions 116A that contribute greater surface area to the base 112 without interfering with the ability of the footwear 110 to fully nest when worm.

FIGS. 12 through 15 illustrate footwear 210 in accordance with a preferred embodiment of this invention. As with the footwear 110 of FIGS. 9 through 11, the footwear 210 of the preferred embodiment is similar to the footwear 10 of FIGS. 1 through 8 with the exception that the outline of its base 212 differs from that of the footwear 10, the footwear 210 employs a contact pad 220 that is preferably an open cell foam rubber, and includes the heel and toe retainers 136 and 138 of the second embodiment. As shown in FIG. 12, the base 212 has a swept-wing shape with a pair of wings 216 extending outwardly from a central portion 214 of the base 212, and the wings 216 include longitudinal extensions 216A that contribute greater surface area to the base 212 without interfering with the ability of the footwear 210 to fully nest with a second identical footwear when worn.

Figure 3:
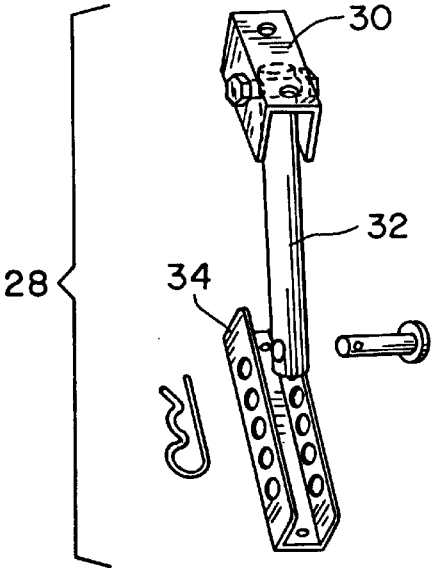
FIG. 3 is a detailed view of an adjuster for the shoe board of FIG. 2.
Figure 13:
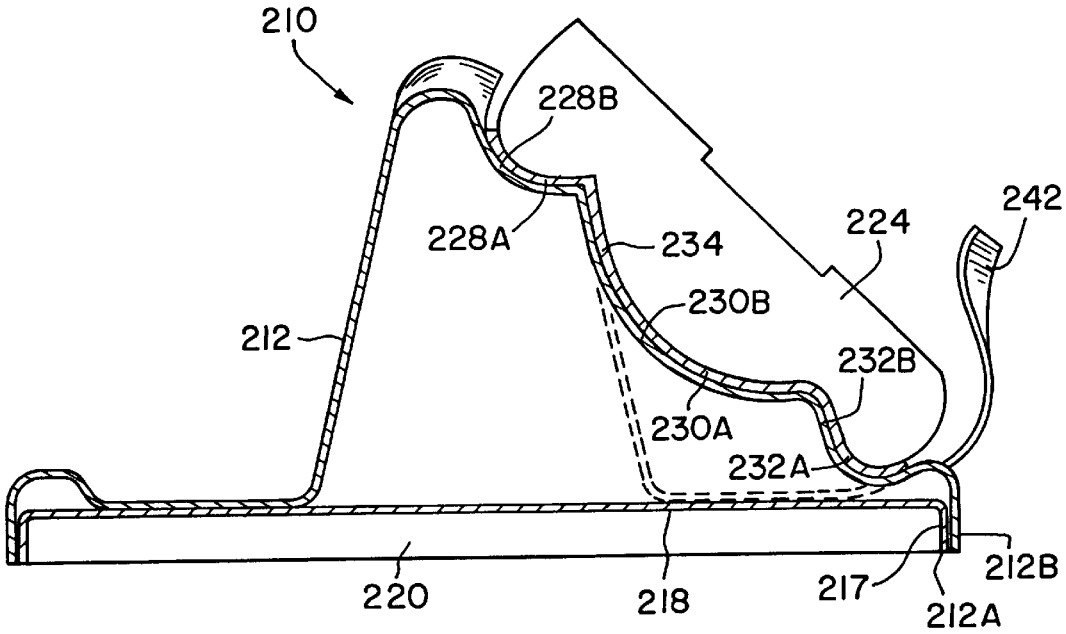
FIG. 13 is a cross-section of the footwear of the preferred embodiment.

The footwear 210 of the preferred embodiment differs from the previous embodiments by its base 212 having a two-piece construction that eliminates the need for an adjustment mechanism of the type shown in FIG. 3. Instead, the base 212 includes a lower section 212A that nests within an upper section 212B whose surface is configured to mate with the lower surface of a complementary-shaped shoe board 224, as shown in FIG. 13. For rigidity, the upper section 212B includes ribs 222 along its perimeter and along the approximate axis of the wings 216. The lower section 212A has a raised rim or lip 217 that surrounds the lower surface 218 of the base 212, forming a cavity into which the contact pad 220 is received. The lower section 212A can be attached to the upper section 212B in any suitable manner, such as with glue or mechanical fasteners.

Figure 15:
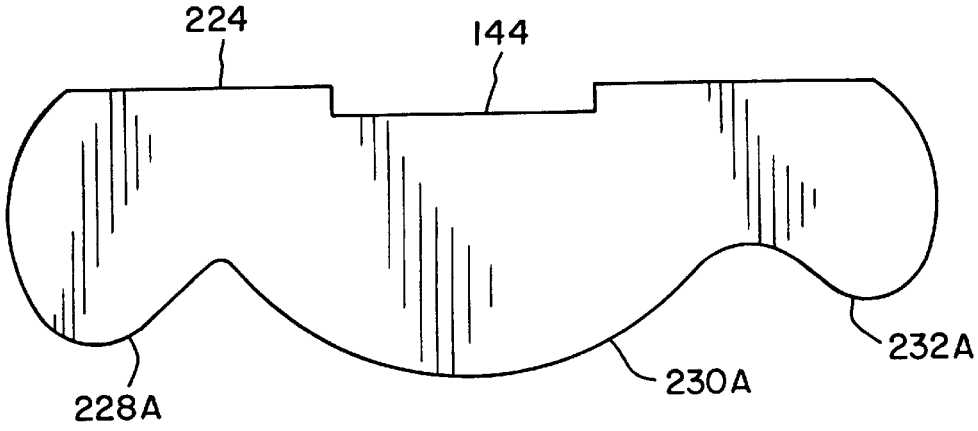
FIG. 15 is a cross-sectional view of the shoe board of FIG. 14.
Figure 14:
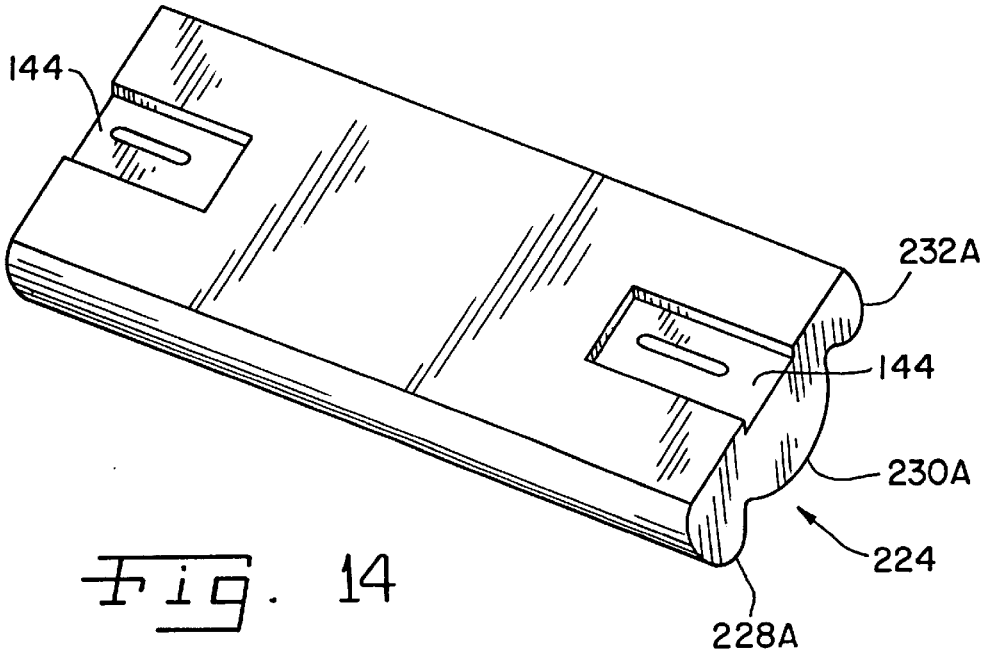
FIG. 14 is a perspective view of the shoe board shown in FIG. 13 mounted to the base of FIG. 12.

The shoe board 224 is shown in FIG. 13 as having three convex portions 228A, 230A and 232A that are received in three concave surface regions 228B, 230B and 232B of the upper section 212B of the base 212. The convex portions 228A, 230A and 232A are generally lobes that extend the length of the shoe board 224 as shown in FIGS. 14 and 15, and the concave surface regions 228B, 230B and 232B have the form of channels as shown in FIG. 12, though it is foreseeable that the portions 228A, 230A and 232A and regions 228B, 230B and 232B could be configured differently from that shown. The uppermost convex portion 228A shown in FIG. 13 is slightly larger than the lowermost convex portion 232A. As a result, the shoe board 224 is at a maximum angle to the base 212 when the larger convex portion 228A is nested in the uppermost concave surface region 228B, and at a minimum angle to the base 212 when the smaller convex portion 232A is nested in the surface region 228B. This arrangement enables the pitch of the shoe board 224 to be alternated between two predetermined values, such as 9/12 and 12/12, thereby allowing the shoe board 224 to be maintained roughly horizontal to a roof whose pitch is 9/12 or 12/12.

FIGS. 12 and 13 show the shoe board 224 as being secured to the base 212 with straps 242 that also secure the wearer's shoe to the shoe board 224. A VELCRO fastener 234 is also shown for securing the shoe board 224 to the base 212. The preferred embodiment of FIGS. 12 through 15 employs the heel retainer 136 and toe retainer 138 of FIGS. 10 and 11, including the tab 140 secured by the fastener 146 to the slotted base plate 144. A wearer dons the preferred footwear 210 by appropriately adjusting the heel and toe retainer 136 and 138, orienting the shoe board 224 on the base 212 to obtain the desired pitch, and then strapping his or her shoe to the shoe board 224 with the straps 242, which simultaneously secures the shoe board 224 to the base 212.

While the invention has been described in terms of a preferred embodiment, it is apparent that other forms could be adopted by one skilled in the art. For example, various materials could be used to form the individual components of the footwear, different fasteners and fastening systems could be used, and the precise dimensions and outline of the bases 12, 112 and 212 could differ from that described. Accordingly, the scope of the invention is to be limited only by the following claims.

What is claimed is:

1. A pair of footwear, each of the footwear comprising:

a base having an upper surface, a lower surface, a longitudinal direction, a lateral direction;

at least two wings substantially coplanar with the base, each of the at least two wings projecting from the base in a direction oblique to the longitudinal and lateral directions of the base, the wings and the base together defining to have a concave lateral edge and an oppositely-disposed convex lateral edge; and adjustable means for supporting and securing a foot of a user to the base, the adjustable means being adjustable between at least two positions in which the adjustable means has at least two different pitches relative to the base;

whereby the pair of footwear are nestable together by placing the pair of footwear side by side such that the convex lateral edge of one of the pair of footwear is received in the concave lateral edge of the other of the pair of footwear.

2. A pair of footwear as recited in claim 1, wherein the adjustable means comprises a platform contacting and supported by the upper surface of the base.

3. A pair of footwear as recited in claim 2, wherein the base comprises at least two concave surface regions substantially parallel to the longitudinal direction of the base.

4. A pair of footwear as recited in claim 3, wherein the at least two concave surface regions define two channels in the upper surface of the base.

5. A pair of footwear as recited in claim 2, wherein the platform has a lower surface and at least two convex portions protruding from the lower surface.

6. A pair of footwear as recited in claim 5, wherein the base comprises at least two concave surface regions into which the at least two convex portions of the platform are received.

7. A pair of footwear as recited in claim 6, wherein a first of the at least two convex portions of the platform projects a greater distance from the upper surface of the platform than a second of the at least two convex portions.

8. A pair of footwear as recited in claim 7, wherein a first of the at least two concave surface regions of the base is spaced a greater distance from the upper surface of the base than a second of the at least two concave surface regions.

9. A pair of footwear as recited in claim 8, wherein the pitch of the platform relative to the base is a maximum when the first of the at least two convex portions of the platform is received in the first of the at least two concave surface regions of the base and the second of the at least two convex portions of the platform is received in the second of the at least two concave surface regions of the base.

10. A pair of footwear as recited in claim 8, wherein the pitch of the platform relative to the base is a minimum when the second of the at least two convex portions of the platform is received in the first of the at least two concave surface regions of the base and the first of the at least two convex portions of the platform is received in the second of the at least two concave surface regions of the base.

11. A pair of footwear, each of the footwear comprising:

a base having an upper surface, a lower surface, a longitudinal direction, a lateral direction transverse to the longitudinal direction, and at least two concave surface regions that define channels in the upper surface of the base, the channels being substantially parallel to the longitudinal direction of the base, a first of the channels being spaced a greater distance from the lower surface of the base than a second of the channels;

a platform contacting and supported by the upper surface of the base, the platform having an upper surface, a lower surface, a longitudinal direction that is substantially parallel to the longitudinal direction of the base, a lateral direction that is transverse to the longitudinal direction of the platform and substantially parallel to the lateral direction of the base, and at least two convex portions protruding from the lower surface of the platform and received in the channels of the base, the platform being adjustable between two positions in which the upper surface of the platform has a maximum and minimum lateral pitch relative to the lower surface of the base; and means for securing a foot of a wearer of the footwear to the upper surface of the platform.

12. A pair of footwear as recited in claim 11, wherein a first of the at least two convex portions of the platform projects a greater distance from the upper surface of the platform than a second of the at least two convex portions, the lateral pitch of the platform relative to the base being a maximum when the first of the at least two convex portions of the platform is received in the first channel of the base and the second of the at least two convex portions of the platform is received in the second channel of the base.

13. A pair of footwear as recited in claim 12, wherein the lateral pitch of the platform relative to the base is a minimum when the second of the at least two convex portions of the platform is received in the first channel of the base and the first of the at least two convex portions of the platform is received in the second channel of the base.

14. A pair of footwear as recited in claim 11, further comprising:

at least two wings substantially coplanar with the base, each of the at least two wings projecting from the base in a direction oblique to the longitudinal and lateral directions of the base, the wings and the base together defining a concave lateral edge and an oppositely-disposed convex lateral edge of the footwear; and a first extension longitudinally extending from a first of the at least two wings in a first direction, and a second extension longitudinally extending from a second of the at least two wings in a direction opposite the first direction;

wherein the pair of footwear are nestable together by placing the pair of footwear side by side such that the convex lateral edge of one of the pair of footwear is received in the concave lateral edge of the other of the pair of footwear.

15. A pair of footwear as recited in claim 11, further comprising:

strap means attached to the base and being sufficiently long to wrap around the platform and a foot of the wearer on the platform for simultaneously securing together the platform, the base and the foot of the wearer; and adjustable means for retaining the heel and toe of the foot of the wearer to the platform.

* * * * *